United States Patent [19]

Priester

[11] 3,961,516

[45] June 8, 1976

[54] APPARATUS AND METHOD FOR RE-FORMING AND MAINTAINING THE CIRCULAR SHAPE OF A DEFORMED ROLL OF MATERIAL

[76] Inventor: Jack E. Priester, 1560 Marcia Ave., Modesto, Calif. 95350

[22] Filed: Jan. 8, 1975

[21] Appl. No.: 539,296

[52] U.S. Cl. ..... 72/370; 29/191; 29/194; 29/423; 72/393

[51] Int. Cl.[2] ..... B21B 17/02

[58] Field of Search ..... 72/392, 393, 370, 367, 72/369; 29/255, 263, 280, 282, 423, 191, 194; 269/48.1; 242/68.5, 117, 118, 118.2; 254/93 R, 126, 124

[56] References Cited

UNITED STATES PATENTS

| | | | |
|---|---|---|---|
| 972,667 | 10/1910 | Wheeler | 242/68.5 |
| 1,623,405 | 4/1927 | Gocke et al. | 72/392 |
| 1,922,716 | 8/1933 | Robinett | 72/393 X |
| 3,292,903 | 12/1966 | Meyer et al. | 254/124 |
| 3,625,046 | 12/1971 | Van Gompel | 72/393 X |
| 3,677,058 | 7/1972 | Van Gompel | 72/393 |

*Primary Examiner*—C. W. Lanham
*Assistant Examiner*—James R. Duzan
*Attorney, Agent, or Firm*—Flehr, Hohbach, Test, Albritton & Herbert

[57] ABSTRACT

An apparatus and method for re-forming and maintaining the circular shape of a deformed roll of material includes a forming means having a rigid arcuate pressure pad adapted to press against and shape an inner surface portion of a coiled roll of material, such as steel, aluminum, or other material adapted to be mounted for rotation in a sheeting operation wherein a web of the material is withdrawn from the roll and cut into predetermined lengths. Hydraulic jacking means carried by a rigid plate disposed as a geometric chord between the ends of the arcuate pressure pad serves to force deformed portions of the center opening of the coil outwardly as the jacking means is operated. A pair of such pads is disposed in opposed relation within the center opening of the coil and an expansible sleeve or liner disposed about the two pads. The liner includes a band of semi-rigid material wrapped cylindrically to dispose the end edges of the band in closely spaced confronting relation separated by a gap therebetween. Arcuate extension plate means extends across the gap and overlays the end margins of the band so as to protect and support the ends of the band during expansion and contraction of the liner. Upon fully expanding the liner, an elongate spacer plate dimensioned and adapted to be interposed between the end edges of the liner retains the edges in predetermined spaced relation for establishing the outer diameter of the liner to correspond to the diameter of the center opening of the coil so as to maintain the cylindrical nature of the coil.

6 Claims, 8 Drawing Figures

APPARATUS AND METHOD FOR RE-FORMING AND MAINTAINING THE CIRCULAR SHAPE OF A DEFORMED ROLL OF MATERIAL

BACKGROUND OF THE INVENTION

This invention pertains to a method and apparatus for re-forming and maintaining the circular shape of a deformed roll of material and is particularly useful in conjunction with re-establishing the annular nature of a coil of material for use in a sheeting system wherein a web of material will be unwound from the coiled roll and portions of the web cut into predetermined lengths, i.e., "sheets". Such sheeting systems typically are found in the steel industry where a length of metal is wrapped as a coil and, ultimately, unwound as another machine cuts the web of steel into predetermined lengths.

Heretofore, there has been some significant loss in the amount of useable metal contained in a given coil where the coil has, for example, been dropped and deformed prior to unwinding so as to cause the roll to be unbalanced during rotation. It will be readily evident that a coil which has been deformed in the foregoing manner will be unsuitable for mounting upon a rotating support spindle in view of the fact that the mass of the coil will be unevenly distributed therearound so as to cause erratic and slower feeding of the sheet material from the coil.

Accordingly, there has been a need for "opening" otherwise crushed center openings of coils of material so as to re-form the coil for mounting upon a rotatable support spindle. In view of the fact that the coil is typically a metal coil wherein there will be some resilience within the coil after it has been wound, the center opening of the coil will necessarily have to be retained in its circular configuration after initially re-forming the opening so as to prevent the coil from returning to its earlier damaged shape.

SUMMARY OF THE INVENTION AND OBJECTS

In general, there is provided an annular coil liner adapted to retain the center of a coil of material. The liner comprises a band of semi-rigid material wrapped cylindrically to dispose the end edges of the band in closely spaced, confronting relation separated by a gap therebetween. Arcuate extension plate means serves to bridge across the gap and overlay the end margins of the band so as to protect and support the ends of the band during expansion and contraction of the liner.

Preferably, an elongate spacer plate dimensioned and adapted to be interposed between the end edges of the band can be inserted after the band has been expanded within the center of the coil to retain the edges in predetermined, spaced relation for establishing the outer diameter of the liner to correspond to the diameter of the center opening of the coil.

The foregoing apparatus has been employed in carrying out the method for re-forming a deformed, annular coil of material and for preserving the re-formed shape of the coil in which the method comprises the steps of inserting into the center opening of the coil a radially expansible, annular coil liner formed of a band of material wrapped cylindrically to dispose the end edges of the band in closely spaced confronting relation separated by a gap therebetween.

The next step is to radially expand the liner within the center opening of the coil with sufficient force to round out and re-form the center opening of the coil while supporting the end margins of the liner against radially inwardly acting forces. A spacer element is then inserted between the confronting ends of the liner so as to retain the liner in its expanded condition.

DETAILED DESCRIPTION OF PREFERRED EMBODIMENT

Figure 5:
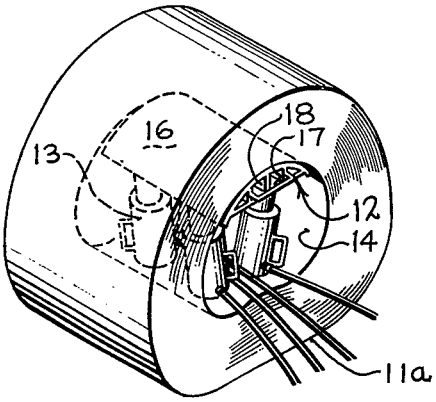
FIG. 5 shows a diagrammatic, perspective view of a coil of material in the initial stages of being re-formed in which one side has been crushed.
Figure 6:
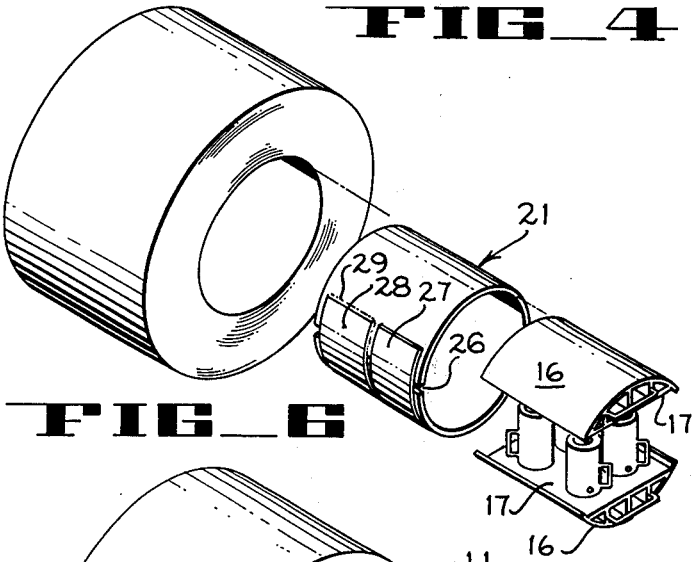
FIG. 6 shows a perspective, exploded, diagrammatic view of an assembly for re-forming and maintaining the circular shape of a deformed roll of material, according to the invention.
Figure 7:
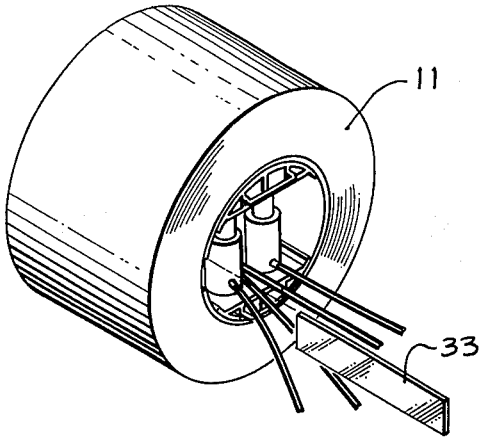
FIG. 7 shows the assembly of FIG. 6 inserted within the center of a coil of material, such as steel, with the spacer plate about to be inserted.
Figure 8:
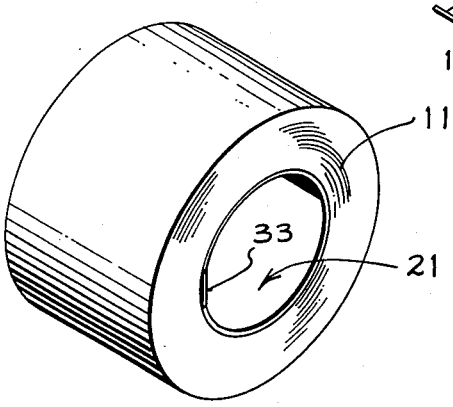
FIG. 8 shows a perspective view of a coil of material in which an expansible, annular liner has been inserted, expanded, and locked in its expanded position by insertion of a spacer element between the confronting end edges of the liner to retain the liner in its expanded position, according to the invention.

As shown in FIG. 5, the coil 11 is disclosed as having been bent or deformed so as to provide a generally flat side 11*a* to the otherwise annular coil configuration.

Apparatus for re-forming the deformed, annular coil comprises forming means adapted to be inserted into the open center of the coil and expanded radially outwardly in order to re-form the coil to its original annular shape. The forming means includes a rigid, arcuate pressure pad 12 adapted to press against and shape an inner surface portion of coil 11.

Hydraulic jacking means 13 extensible between retracted and extended positions is inserted within the center opening 14 of coil 11.

Pressure pad 12 comprises an arcuate member 16 formed with a rigid plate 17 of suitable material, such as steel disposed as a geometric chord between the ends of the arcuate member 16.

Plate 17 remains rigidly supported from the inner surface of arcuate member 16 by means of the longitudinally extending rigid webs 18 interposed between plate 17 and member 16.

Plate 17 is thus disposed and adapted to support hydraulic jacking means 13 when the forming means has been disposed within the center of coil 11 so as to permit the jacking means to be extended and to urge pressure pad 12 against an inner surface portion of coil 11 to round out the coil in the region of the surface portion contacted by pad 12.

Preferably, the forming means includes a pair of rigid, arcuate pressure pads 12, each adapted to press against and to conform to an associated inner surface portion of a coil to be re-formed.

Figure 1:
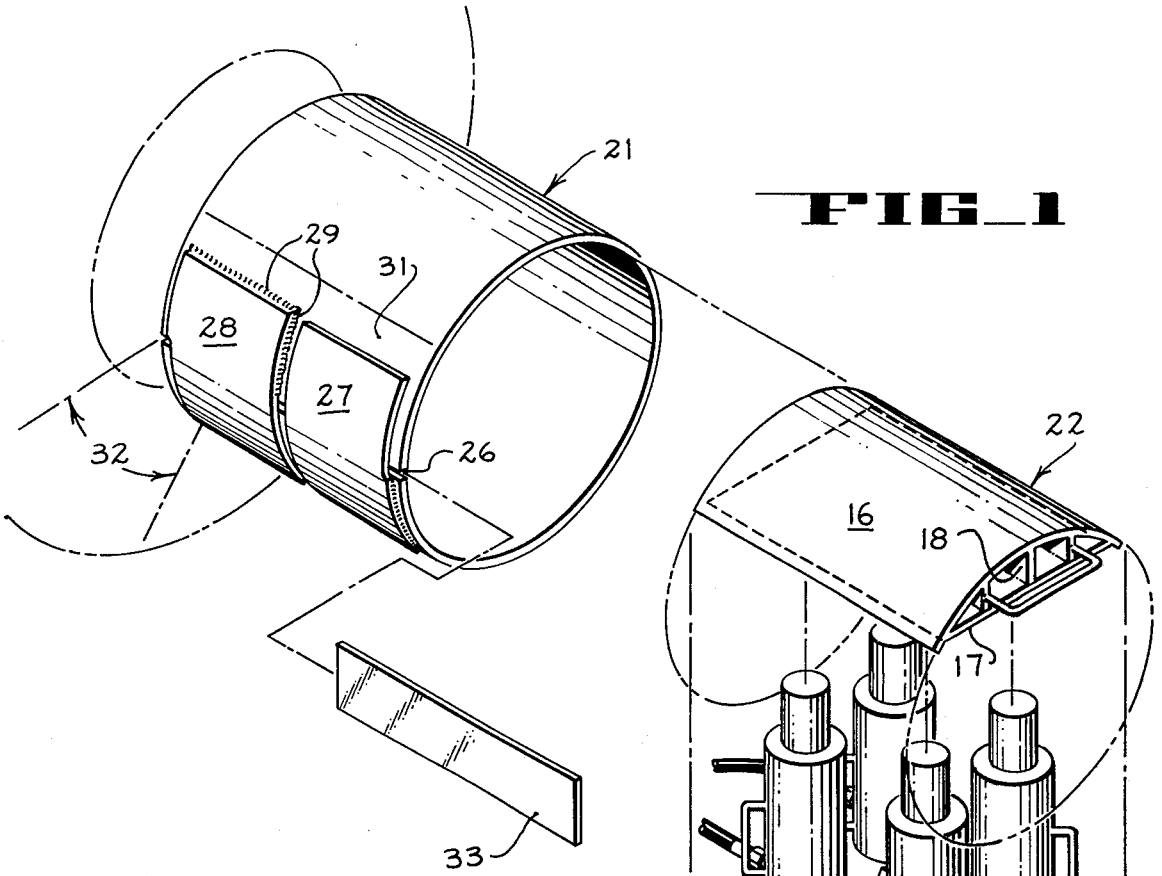
FIG. 1 shows an exploded, perspective view of apparatus for re-forming and maintaining the circular shape of a deformed roll of material, according to the invention.

As shown in FIG. 1, a radially expansible coil liner 21 is formed of a band of semi-rigid material, such as steel, wrapped cylindrically to dispose the end edges 23, 24 of the band in closely spaced confronting relation separated by a gap 26 therebetween so as to permit the liner 21 to be radially enlarged.

Liner 21 is typically disposed about and carried by the pair of pressure pads 22 (comparable to pads 12) for expansion therewith under action of the jacking means 13.

The expansible, annular coil liner 21 is adapted to be locked in its expanded condition so as to retain the center opening in the coil of steel or other material in circular form. Means are provided for insuring that liner 21 can be radially expanded without locally relieving the compressive force of the coil being expanded. Thus, the end margins of liner 21 are supported against being collapsed during expansion of liner 21 by arcuate extension plate means, such as the pair of elongate arcuate extension plates 27, 28 bridging gap 26. Plates 27, 28 are secured respectively to the outer surface of opposite end margins of the band which forms liner 21. Each plate 27, 28 bridges gap 26 sufficiently to overlay in closely spaced relation an end margin of the band of material forming liner 21 on the opposite side of gap 26 from that side of the gap 26 to which the particular extension plate is secured. For example, plate 28 has been welded by means of the weld line 29 to the end margin 31 whereas the other end of arcuate extension plate 28 overlays in closely spaced relation the end margin 32. Thus, upon expansion of liner 21, plates 27, 28 serve to guide and support alignment between the end edges 23, 24 while precluding either of the two end margins from bending inwardly under the pressure of the coil acting against the outward urging of the pressure pads.

After liner 21 has been expanded to a predetermined degree, an elongate spacer plate 33 can be interposed between end edges 23, 24 of the liner band so as to engage and retain the end edges in spaced relation upon removal of the jacking means and pressure pads 22.

Figure 2:
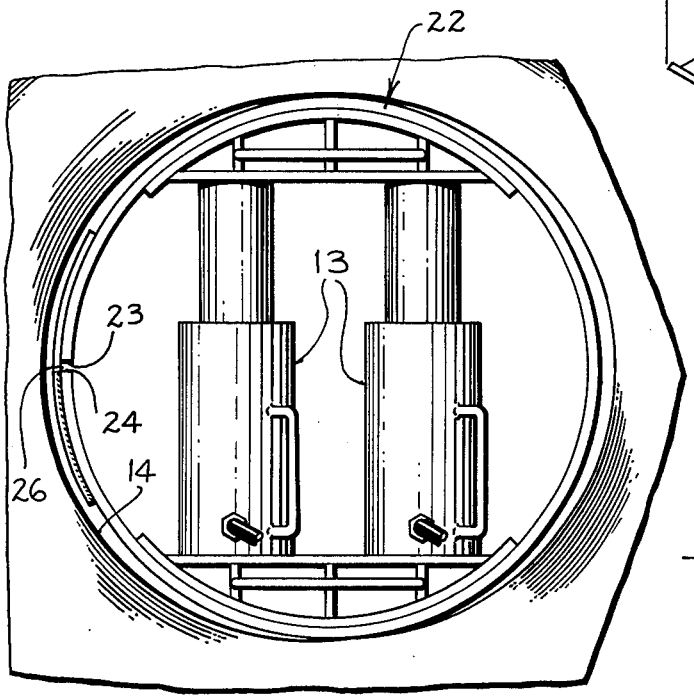
FIG. 2 shows an end elevation view of the apparatus shown in FIG. 1 inserted within the center of the coil and with the jacking means thereof retracted.

In short, after initially opening the deformed center opening 14, as shown in FIG. 5, of a coil 11 of steel, aluminum, or other material adapted to be employed in a sheeting machine or system, the two pressure pads and jacking means are disposed within the open center 14 with the jacking means in retracted position so as to permit the foregoing equipment to be inserted as shown in FIG. 2.

Figure 3:
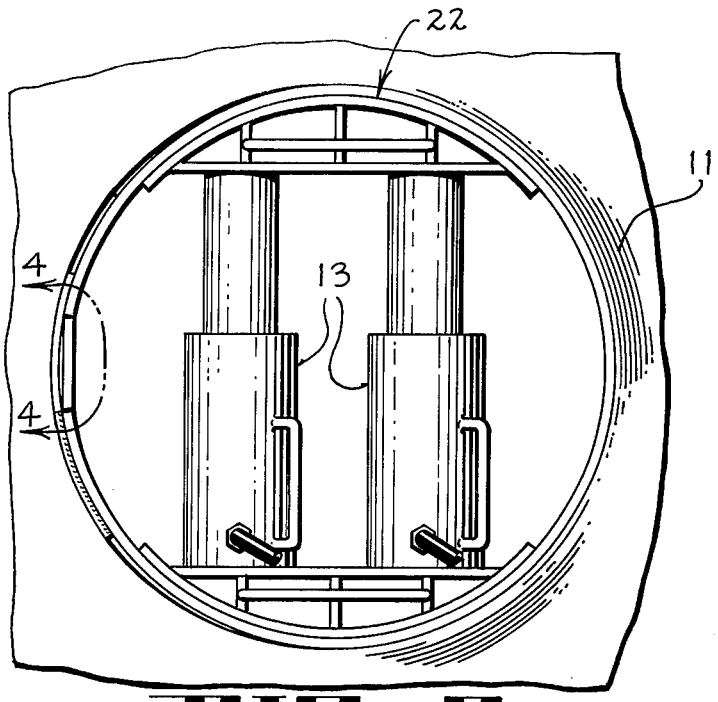
FIG. 3 shows an end elevation view similar to FIG. 2 with the jacking means projected and with a spacer plate inserted to retain the expanded circumference of the inserted liner.

FIG. 3 discloses the same arrangement with the jacking means 13 operated to its extended position thereby rounding out the center opening 14 of coil 11.

Figure 4:
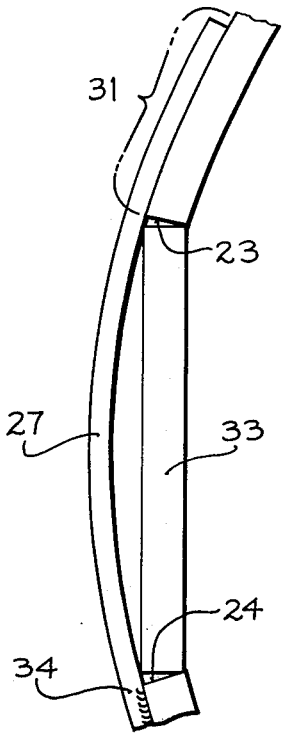
FIG. 4 shows an enlarged detail view of FIG. 3 taken at line 4—4 of FIG. 3.

As shown best in FIG. 4, an arcuate extension plate 27 welded at 34 to an end margin of liner 21 bridges the gap defined between edges 23, 24 so as to overlie the end margin 31 in sliding and supporting relation.

Another plate 28 extends in an opposite direction and is disposed in the same manner.

From the foregoing, it will be readily evident that a method for re-forming a deformed, annular coil 11 into predetermined lengths thereof and for preserving the re-formed annular shape of the coil includes the steps of inserting into the center opening 14 of the coil a radially expansible, annular coil liner 21 formed of a band of material wrapped cylindrically to dispose the end edges 23, 24 of the band in closely spaced confronting relation separated by a gap 26 therebetween. The next step is to radially expand the liner 21 within center opening 14 with sufficient force to round out and re-form the center opening and coil 11 while supporting the ends of liner 21. Subsequently, locking element 33 is inserted between the confronting ends 23, 24 of liner 21 to retain liner 21 in its expanded condition to overcome any tendency of the coil to re-form itself into its prior deformed condition.

Following the foregoing method, it will be evident that there is produced a combination of a coil of material 11 of a type to be unwound and cut into predetermined lengths comprising a radially expansible, annular core liner 21 within the coil. The liner is formed of a band of material wrapped cylindrically to dispose the end edges of the band in spaced confronting relation separated by a gap therebetween. Arcuate extension plate means disposed to extend across the gap in supporting relation to the opposite end margins of liner 21. Further, an elongate spacer plate is interposed between the end edges to retain the edges in predetermined spaced relation for maintaining the outer diameter of the liner at an expanded condition thereof to correspond to the diameter of the center opening of the coil.

Thus, there has been provided both an improved method of re-forming deformed coils and maintaining such coils in a substantially cylindrical, annular condition for rotation as well as a device for carrying out such method.

I claim:

1. A method for re-forming a deformed annular coil of material of a type to be unwound from the coil and cut into predetermined lengths thereof and for preserving the re-formed shape of said coil comprising the steps of inserting into the center opening of said coil a radially expansible annular coil liner formed of a band of material wrapped cylindrically to dispose the end edges of said band in closely spaced confronting relation separated by a gap therebetween, radially urging said liner from within said center opening with sufficient force to round out and re-form the center opening and coil while spacing the confronting ends of said liner, inserting a spacer element between the spaced apart ends of said liner to retain said liner in its expanded condition upon release of the radial urging, and thereafter removing means for radially expanding said liner from said center opening.

2. Apparatus for re-forming a deformed annular coil of material comprising forming means adapted to be inserted into the open center of the coil, said forming means having a pair of rigid arcuate pressure pads each adapted to press against and conform to an associated inner surface portion of the coil, hydraulic jacking means extensible between retracted and advanced positions, rigid plate means disposed as a chord between the ends of each said arcuate pressure pads, means rigidly supporting each said plate means from an associated one of said pressure pads, each said plate means being disposed and adapted to support said hydraulic jacking means thereon when said forming means has been disposed within said deformed coil to permit the jacking means to extend and conjointly urge said pressure pads toward said inner surface portions to round out said coil in the region of said inner surface portions, and a radially expansible coil liner formed of a band of material wrapped cylindrically to dispose the end edges of said band in closely spaced confronting relation separated by a gap therebetween so as to permit said liner to be radially enlarged, said liner being disposed about and carried by said pair of pressure pads for expansion therewith under action of said jacking means, and first and second arcuate extension plates secured respectively to the outer surface of opposite end margins of said liner, each said first and second plates bridging said gap sufficiently to overlay an end margin of said liner on the opposite side of said gap, whereby upon expansion of said liner said first and second plates serve to support the end margins of said liner.

3. Apparatus according to claim 2 comprising an elongate spacer plate interposed between the end edges of said band to engage and retain same in spaced relation to permit removal of said jacking means and said pressure pads.

4. In combination a coil of material of a type to be unwound and cut into predetermined lengths comprising a radially expansible annular core liner within said coil, said liner being formed of a band of material wrapped cylindrically to dispose the end edges of said band in spaced confronting relation separated by a gap therebetween, arcuate extension plate means carried by said liner and extending across said gap in supporting relation to the end margins of said liner, and an elongate spacer plate interposed between said end edges to retain said edges in predetermined spaced relation for maintaining the outer diameter of said liner at an expanded condition thereof to correspond to the diameter of the center opening of the coil.

5. A radially expansible annular coil liner adapted to retain the center opening of a coil of material, said liner comprising a band of material wrapped cylindrically to dispose the end edges of said band in closely spaced confronting relation separated by a gap therebetween, first and second arcuate extension plates secured respectively to the opposite end margins of said band, each said first and second arcuate plate extending across said gap in overlapping radially supporting relation to an end margin of said liner, and an elongate spacer plate dimensioned and adapted to be interposed between said end edges to retain said edges in predetermined spaced relation for establishing the outer diameter of said liner to correspond to the diameter of the center opening of the coil.

6. A radially expansible annular coil liner adapted to retain the center opening of a coil of material, said liner comprising a band of material wrapped cylindrically to dispose the end edges of said band in closely spaced confronting relation separated by a gap therebetween, arcuate extension plate means disposed to extend across said gap in radially supporting relation to the opposite end margins of said band during expansion and contraction of said band liner.

* * * * *